US005595245A

United States Patent [19]

Scott, III

[11] Patent Number: 5,595,245

[45] Date of Patent: Jan. 21, 1997

[54] SYSTEMS OF INJECTING PHENOLIC RESIN ACTIVATOR DURING SUBSURFACE FRACTURE STIMULATION FOR ENHANCED OIL RECOVERY

[76] Inventor: George L. Scott, III, 100 N. Pennsylvania, Roswell, N.M. 88201

[21] Appl. No.: 511,244

[22] Filed: Aug. 4, 1995

[51] Int. Cl.[6] ..... E21B 43/267; E21B 47/06

[52] U.S. Cl. ..... 166/250.1; 166/250.12; 166/280; 166/308

[58] Field of Search ..... 166/308, 250.12, 166/280, 295, 250.1, 250.07, 247

[56] References Cited

U.S. PATENT DOCUMENTS

| | | | |
|---|---|---|---|
| 2,888,988 | 6/1959 | Clark | 166/280 |
| 2,951,535 | 9/1960 | Mihram et al. | 166/280 X |
| 2,986,538 | 5/1961 | Nesbitt et al. | 166/276 X |
| 3,026,938 | 3/1962 | Huitt et al. | 166/280 |
| 3,929,191 | 12/1975 | Graham et al. | 166/280 X |
| 4,336,842 | 6/1982 | Graham et al. | 166/280 X |
| 5,322,126 | 6/1994 | Scott, III | 166/308 |
| 5,413,179 | 5/1995 | Scott, III | 166/308 |
| 5,520,250 | 5/1996 | Harry et al. | 166/280 X |

OTHER PUBLICATIONS

"A Quick Setting Chemical to Bond Curable Resin Coated Particles," Santrol Technical Bulletin, pp. 1–2 (date unknown).

*Primary Examiner*—Stephen J. Novosad
*Attorney, Agent, or Firm*—Louis J. Hoffman

[57] ABSTRACT

In connection with downhole placement of proppant materials for the purpose of enhancing oil recovery through a subsurface fracture-stimulation treatment, phenolic resin activator is injected after resin-coated proppant is pumped. The results are a reduced probability of problems attendant to premature screenout, savings in the quantity of activator needed, more concentrated placement of the activator close to the wellbore, and the ability to continue the fracturing treatment longer. Injection of activator is accomplished through tubing extending at least as deep as the perforations, while injection of proppant is done through the tubing-casing annulus.

29 Claims, 3 Drawing Sheets

SYSTEMS OF INJECTING PHENOLIC RESIN ACTIVATOR DURING SUBSURFACE FRACTURE STIMULATION FOR ENHANCED OIL RECOVERY

FIELD OF THE INVENTION

The inventive methods relate to apparatus and methods useful in enhancing the recovery of petroleum reserves, principally oil and gas, through downhole injection of proppant materials, which creates and holds open fractures in the oil-producing formation adjacent to the wellbore.

BACKGROUND OF THE INVENTION

Oil recovery, particularly from economically marginal wells, is enhanced by injecting a fracturing material, typically polymer-gelled water mixed with sand, into the wellbore. The fracturing fluid is forced under pressure into the producing formation, hydraulically inducing fractures, and the fractures are propped open by the proppant, such as the sand. Known proppant alternatives to sand include glass beads and certain ceramics. That known process enhances production by permitting oil more distant from the hole to flow to the wellbore, from which it can flow or be pumped to the surface.

The oilfield industry often uses phenolic resin coating on proppants in such downhole reservoir fracture stimulation procedures. Presently, the oil industry uses millions of pounds of resin-coated proppant per year for fracturing treatments.

Typically, after placement into the reservoir fracture, the resin coating on the proppant undergoes physicochemical change due to temperature and reaction with a chemical activator. The activator hastens the process first by softening the resin coat, which becomes sticky. Next, the resin-coated proppant material congeals into a hardened, permeable mass, thus inducing bonding of the packed proppant in the fracture. Such hardening is useful because (1) it helps reduce proppant migration from the fracture into the wellbore, which is undesired because it can cause granular erosion and sticking of the pump and other equipment during subsequent production, and (2) it reduces the likelihood of crushing within the fracture, which is undesired because it results in fine debris and increased fracture closure, thereby reducing fluid flow to the wellbore. The net result of the process is a polymer filter pack around the wellbore, which facilitates long-term pumping and enhanced fluid production rates.

In known hydraulic fracturing processes, the chemical activator and the resin-coated proppant are mixed at the surface and pumped into the hole together.

A common problem associated with activated resin-coated proppant occurs from premature "screenout," which is caused by excessive fluid bleedoff of the fracturing gel into the surrounding formation rock. Screenout causes chemically activated resin-coated sand in the fracturing gel to pack the fracture and extend back into the wellbore. The proppant thus becomes concentrated in the wellbore as sticky, cohesive plugs. If screenout occurs before the fracturing treatment is completed, the plugs will block entry of further proppant and cause abrupt increases in injection pressures.

To improve reservoir stimulation success, operators often use relatively low pump-injection rates to minimize or control the growth of hydraulic fractures. Premature screenout also often occurs during low-rate fracturing treatments. Premature screenout frequently occurs in higher-permeability reservoirs and in association with relatively high proppant concentrations in the fracturing fluid.

During many hydraulic fracture treatments, and particularly during real-time tracer monitoring of fracture treatments (as disclosed in my U.S. Pat. Nos. 5,322,126, 5,413,179, and 5,441,110), a tubing string and associated mechanical packers and retrievable bridge plugs are present in the wellbore. As a result of premature screenout, the tubing and associated wellbore tools frequently become stuck by the chemically activated resin-coated proppant. That occurrence significantly complicates the situation, frequently resulting in expensive fishing operations to retrieve stuck tubing and wellbore tools.

Premature screenout causes severe economic consequences to the operator. Sometimes wells are permanently lost or damaged when fishing or cleaning operations are unsuccessful, particularly when activated resin-coated proppant is used. Premature screenout is a problem preferably avoided by careful design of the hydraulic fracturing treatment, but in reality the occurrence of premature screenout is difficult to predict or consistently avoid by design. As a result, many operators are reluctant to pump chemical activator in the fracturing fluid from the surface, as is the common industry method, because of the risks of ruining the well or causing expensive remedial work. That reluctance itself may result in lost production, if the process would have worked to enhance the oil production from the well.

Presently, an operator observes screenout by noting, using existing monitoring techniques, an increase in injection pressures monitored at the surface, or an increase in the bottomhole treating pressure via downhole measurement devices. Depending on circumstances, the operator may (1) immediately switch from the proppant-slurry pumping stage to the flush stage minus sand proppant, (2) increase the pumping rate, or (3) abruptly terminate the fracturing treatment.

The option of increasing the pumping rate is intended to overcome the fluid bleedoff rates in the fracture. Often, a timely rate increase overcomes fluid loss in the formation or increases induced fracture width, allowing the treatment to be completed. Otherwise, the increased pressures forces the operator to shut down the pumping procedure abrubtly and respond with immediate remedial action to circulate the sand proppant out of the hole. Immediate circulation is often difficult, however, because of the hydrostatic pressure of the heavily sand-laden fluid in the hole, often combined with continuous fluid seepage into the fracture-stimulated reservoir. Also, increased pumping rates may cause the fractures to extend out of the producing zone, causing subsequent excessive water influx into the wellbore or otherwise ruining the well. Thus, present techniques of responding to premature screenout may fail to permit continued proppant injection or even worsen the problem.

It is, therefore, a primary object of the invention to permit the use of selectively activated resin-coated proppant with reduced risk of premature screenout.

It is another object of the invention to improve the production from oil and gas wells.

It is another object of the invention to promote the successful completion of hydraulic fracturing treatments.

It is another object of the invention to allow the use of resin-coated proppant without risking stuck tubing or wellbore tools.

It is another object of the invention to permit the more safe use of hydraulic fracturing treatments while downhole equipment and tubing is present in the hole.

It is another object of the invention to permit the more safe use of hydraulic fracturing treatments that have low injection rates or high proppant concentration, or that are directed to high-permeable reservoirs.

It is another object of the invention to facilitate the precise, concentrated placement of chemical activation and to improve the quality and fluid conductivity of the proppant-packed fracture system adjacent to the wellbore.

It is another object of the invention to reduce the quantity and cost of chemical activator associated with fracturing treatments.

It is another object of the invention to prevent or more easily cure detrimental and potentially hazardous side effects associated with fracturing treatments.

SUMMARY OF THE INVENTION

The above and other objects of the invention are achieved in a preferred embodiment through a method that includes selectively injecting chemical activator into the frac fluid flowstream in the production casing annulus at the perforations, such as via injection through a tubing injector placed adjacent to the perforated reservoir interval. If screenout is not observed, the activator is pumped into the frac fluid flowstream at the end of the fracturing treatment.

After pumping of tracer material down the casing annulus concurrent with real-time monitoring, chemical activator is then injected downhole into the flowstream from the tubing adjacent to the perforated interval. At the end of the fracturing treatment, the operator then has the option of continuing to pump down tubing and back up the casing annulus, to circulate the hole clean before retrieving tubing and tools and swabbing or flowing back the treated well.

The innovative procedure allows the operator to control placement of the chemical activator selectively into the proppant entering the perforated reservoir interval during the final stage of the fracturing treatment. This procedure has the particular advantage of reducing the risk of premature screenout caused by using resin-coated proppant, particularly in risky situations, including where tubing is present, such as when real-time monitoring is being done, where a low-rate or high-proppant-concentration treatment is desired, or where the reservoir is a highly permeable one.

The invention allows the operator to avoid migration of chemically activated resin-coated sand vertically throughout the wellbore. It further allows the operator to greatly minimize or eliminate the incidence of resin-coated proppant plugging the wellbore and sticking equipment.

The innovative procedure facilitates precise, concentrated placement of chemical activator, thus eliminating excessive costs of otherwise pumping said activator throughout a fracturing treatment. With precise distribution of chemical activator, the polymerized, packed proppant in the fractures adjacent to the wellbore will be concentrated and well developed, thus maximizing fluid conductivity from the reservoir to the wellbore.

Other aspects of the invention will be appreciated by those skilled in the art after reviewing the following detailed description of the invention.

BRIEF DESCRIPTION OF THE DRAWINGS

The novel features of the invention are described with particularity in the claims. The invention, together with its objects and advantages, will be better understood after referring to the following description and the accompanying figures, in which common numerals are intended to refer to common elements.

DETAILED DESCRIPTION OF THE PREFERRED EMBODIMENTS

Figure 1:
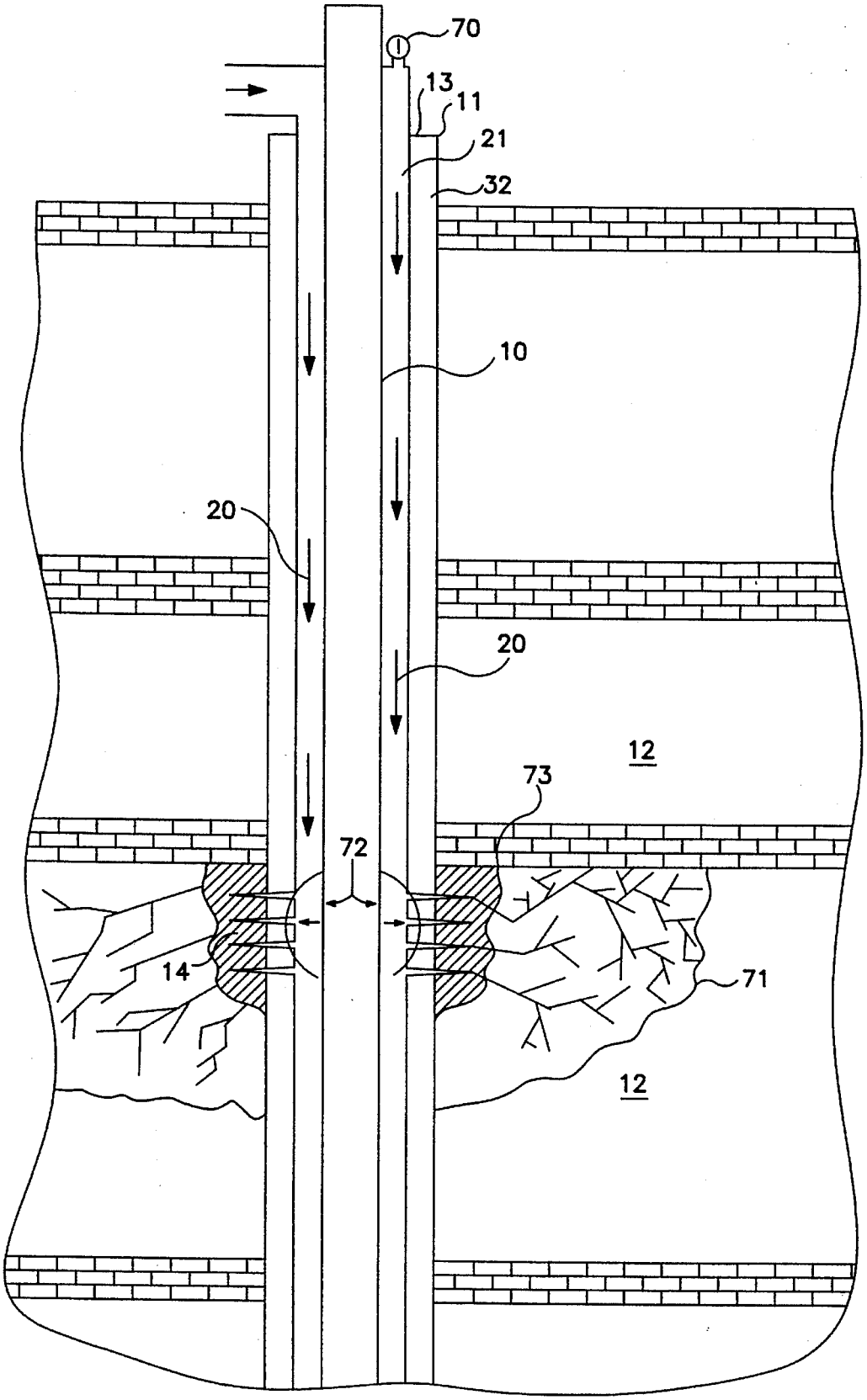
FIG. 1 shows a cross-sectional view of a wellbore (not to scale) in accordance with the invention.

FIG. 1 shows a cross-sectional view of the wellbore, producing fractures, and apparatus used with the system of the invention. Wellbore 11 is lined with casing 13, which is held in place with cement 32 and perforated with holes 14 in the interval adjacent to oil-bearing zone 12. In the prior art system discussed in the "Background of the Invention," above, resin-coated proppant and chemical activator are pumped together under pressure into the cased wellbore, generally with no tubing or downhole equipment therein or empty tubing extending only to perforations 14.

In the inventive system, however, tubing 10 (extending to perforations 14 or completely downhole) is suspended inside casing 13. Proppant is pumped in casing-tubing annulus 21, as indicated by the arrows 20, and exits perforations 14 to the formation, causing fracturing. In the inventive system, proppant 20 is resin-coated but not activated. As pumping continues, proppant 20 extends and props the fractures, to the limit of fracturing denoted by numeral 71 in FIG. 1.

If it is desired to use the inventive system in association with real-time monitoring of the fracturing treatment, monitoring equipment (not shown) can be suspended on a wireline inside tubing 10, and tracer material can be injected during fracturing, all in accordance with the apparatus and methods disclosed in my U.S. Pat. Nos. 5,322,126, 5,413,179, and 5,441,110, or my co-invented application Ser. No. 08/434,669, all of which are hereby incorporated by reference. With the inventive system, as opposed to the prior art systems, the use of tubing during fracturing will not significantly increase the probability of sticking associated with screenout or the risks from performing a fracturing treatment.

Surface pressure monitor 70 permits the operator to observe pressure increases associated with a developing screenout condition, which may occur even though the resin coating on the sand is not activated. However, in the event that flowback or screenout begins, the operator may flush the sand from wellbore 11 before it causes serious damage, by circulating fluid, including liquids such as water or gases such as nitrogen, down tubing 10 and up casing-tubing annulus 21 in opposition of the arrows shown in FIG. 1. Alternatively, monitor 70 can be located downhole in the inventive systems, such as attached to tubing 10.

So long as pressure monitor 70 does not record increased pressure, indicating flowback and screenout, and so long as the real-time monitoring system does not indicate that the fractures are at risk of extending out of zone, the operator may elect to continue pumping proppant. Continued pumping of proppant is desirable, because typically, the longer the propped fractures extend, the greater the probability of higher petroleum recovery, and the longer the proppant is pumped, the longer the fractures will extend. Particularly if the inventive system is used together with real-time monitoring to avoid out-of-zone treatment, the pumping of proppant can continue for as long as it takes until the pressure begins to rise indicating screenout. Thus, the maximum amount of proppant possible can be placed in the fractures.

If screenout begins to occur only after sufficient proppant has been pumped, or if the operator wishes to cease fracturing before screenout occurs (such as because of the risk of fracturing out of zone), then the operator ceases the injection of proppant but continues injecting fluid, to flush the sand-laden material from the wellbore into the reservoir formation. During this final flush stage, or at the very end of the immediately previous proppant injection stage, the operator selectively releases into the flowstream chemical activator 72, from tubing 10. Suitable types of chemical activator include Santrol's products sold under the trademarks Superset W or Superset O.

FIG. 1 shows activator 72 exiting the tubing next to perforations 14 and proceeding into the fractures. Any form of injection suited for accomplishing that goal can be used. For example, the technique of pumping fluid from the surface through the tubing at a surface injection pressure equivalent to or slightly higher than the pressure monitored in the casing-tubing annulus may be used. That technique results in the bottomhole tubing treating pressure being at least as great as the bottomhole annulus treating pressure.

Figure 2:
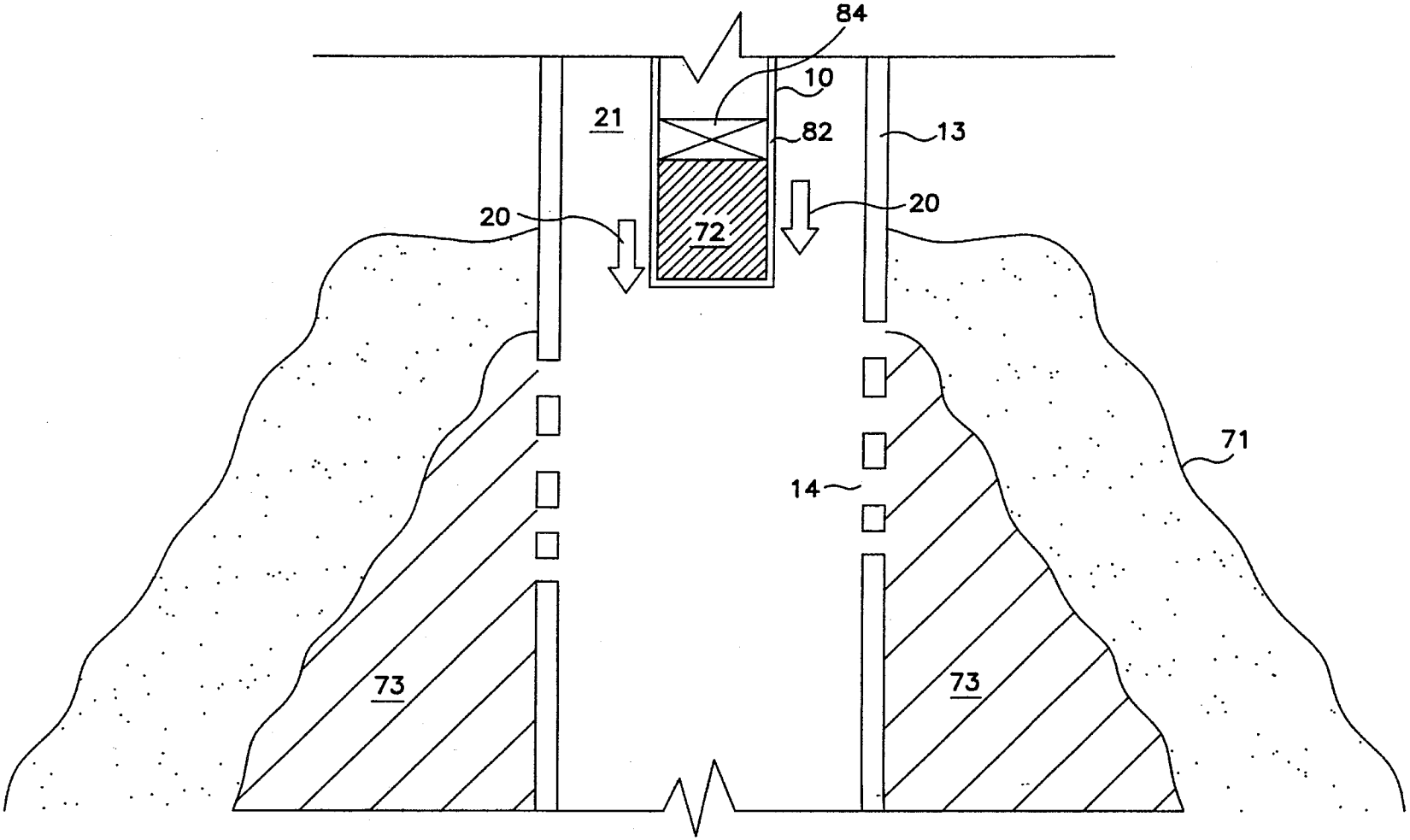
FIG. 2 shows a close-up, cross-sectional view of a portion of the system of FIG. 1 showing a particular embodiment of a system for injecting activator.

Alternatively, a special segment of tubing containing activator may be placed adjacent to the perforations and breached upon command, by pressure or mechanical means. FIG. 2 shows a special segment 82 of tubing suspended near the perforations 14. The tubing can continue below the seqment 82, if desired. Displacement wiper plug 84 holds the activator 72 in place, until a low-volume fluid flow in the tubing forces activator 72 into the formation.

Activator 72 is typically in liquid state. Thus, as activator 72 exits perforations 14, it can flow between the proppant grains in the fractures without physical obstruction. As activator material passes into the formation, it will cause the resin-coated proppant to congeal into a hardened mass. If pressure has begun to rise before activator injection is begun, indicating that the fractures have begun to fill and screenout is potentially imminent, it would be expected that activator flow will be resisted by backflow, resulting in most of the activator being placed closest to borehole 11, causing solidification of the proppant there, which is desired. Shaded areas 73 in FIGS. 1 and 2 show the extent of placement of the activator. In this fashion, the quantity of activator needed is therefore lessened, as compared to prior art systems that inject activator together with proppant, typically throughout the treatment.

After the activator is injected, the well can be shut in for a period of time, as is conventional, to permit curing of the resin-coated proppant before recovery activities are started. In the inventive system the operator has the additional option of using the tubing and the annulus to circulate water or other fluid, to clean the hole in the manner discussed above.

The use of downhole tubing injection, however the injection is accomplished, therefore permits immediate response to screenout at the end of a fracturing treatment, as well as options for prevention or ameliorating the impact of premature screenout.

Figure 3:
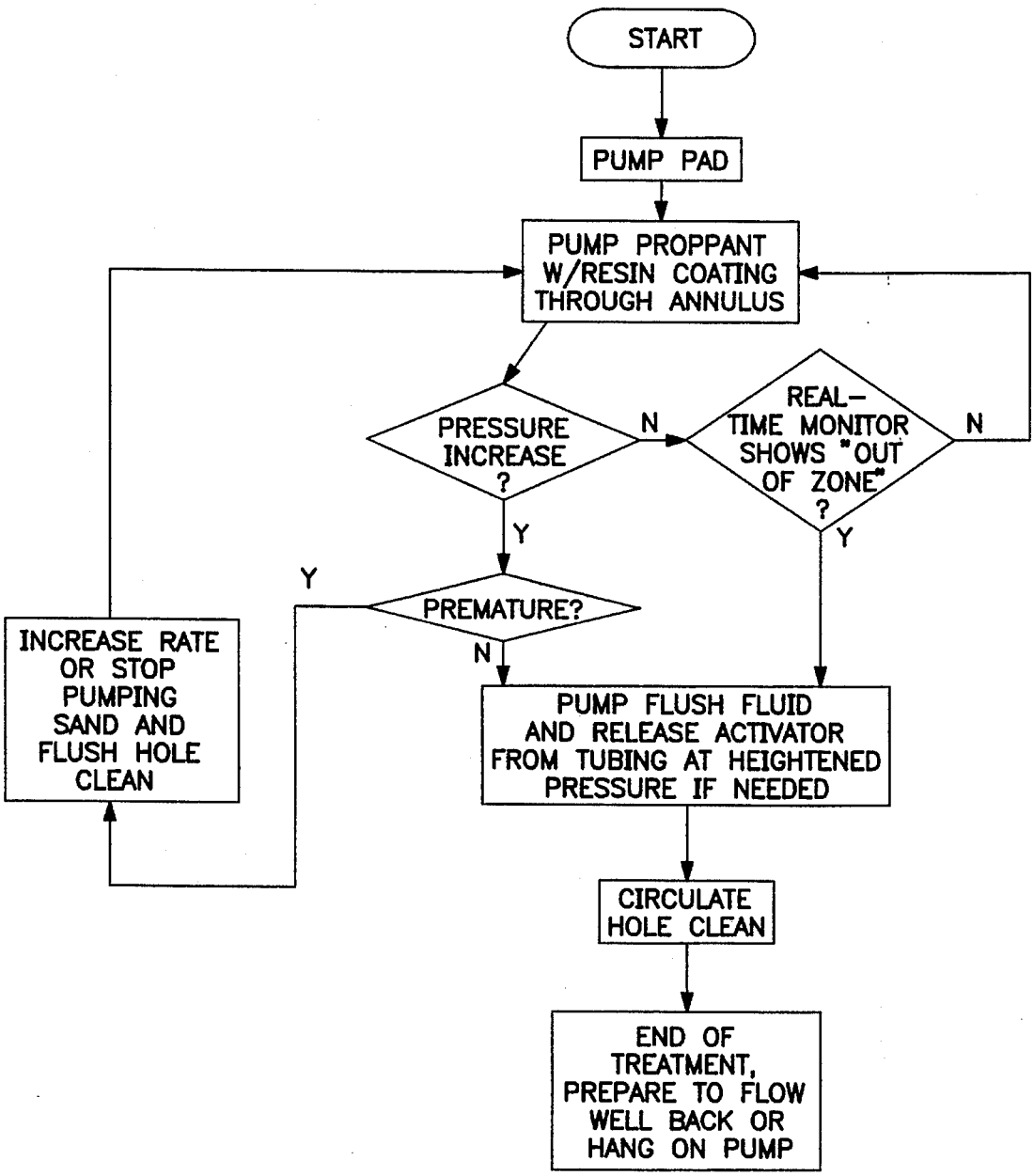
FIG. 3 is a flowchart showing a process of injecting activator in accordance with the invention.

FIG. 3 is a flowchart showing schematically the disclosed methods, including the options discussed above. Not all of the acts shown in FIG. 2 are necessary for all fracturing treatments, in accordance with the comments above. The system may be automatically implemented, or else a human operator can monitor pressure and perform the process manually.

In combination with the above-disclosed methods, it is also possible to tag activator 72 with a distinctive radioactive tracer material (not shown), to measure the permeability of the propped fractures at the final stage of the fracturing treatment. The radioactivated material can be detected in real time as described in my earlier patents listed above.

Although the invention has been described with reference to specific embodiments, many modifications and variations of such embodiments can be made without departing from the innovative concepts disclosed.

Thus, it is understood by those skilled in the art that alternative forms and embodiments of the invention can be devised without departing from its spirit and scope. The foregoing and all other such modifications and variations are intended to be included within the spirit and scope of the appended claims.

I claim:

1. A method of fracturing a subsurface formation adjacent to a cased well containing tubing comprising:

(a) pumping a mixture containing fluid and non-activated resin-coated proppant downhole between casing and tubing, thereby causing the mixture to pass under pressure through perforations in the casing; and (b) after pumping of the proppant is substantially complete, breaching a tubing-conveyed container holding a quantity of activator fluid, thereby causing the activator fluid to pass from the tubing through perforations in the casing.

2. The method of claim 1 wherein part (b) is performed while fluid is pumped between casing and tubing.

3. The method of claim 1 further comprising, during part (a), monitoring the pressure in the well and ceasing the pumping of proppant when the pressure exceeds a predetermined level.

4. The method of claim 3 wherein the activator fluid is pumped at a surface injection pressure at least as great as the monitored surface injection annulus pressure.

5. The method of claim 1 further comprising, after part (b), pumping fluid down the tubing and up the annulus between the casing and the tubing.

6. A method of producing oil by fracturing a subsurface formation adjacent to a cased well containing tubing comprising:

(a) pumping a mixture containing fluid and non-activated resin-coated proppant downhole between casing and tubing, thereby causing the mixture to pass under pressure through perforations in the casing;

(b) while pumping the mixture, monitoring the surface injection annulus pressure in the well;

(c) ceasing the pumping of proppant when the pressure exceeds a predetermined level;

(d) after pumping of the proppant is substantially complete, causing an activator fluid to pass from the tubing through perforations in the casing;

(e) thereafter pumping cleaning fluid down the tubing and up the annulus between the casing and the tubing; and (f) thereafter extracting oil flowing into the casing from the well.

7. The method of claim 6 further comprising:

(a) while pumping the mixture, causing radioactivated tracer to enter the formation with the mixture;

(b) measuring the level of radioactivity at a predetermined vertical distance from the perforations in the casing;

(c) ceasing the pumping of proppant at the earlier of (i) when the pressure exceeds a first predetermined level, and (ii) when the measured level of radioactivity exceeds a second predetermined level; and (d) tagging activator with radioactive tracer.

8. The method of claim 6 wherein the cleaning fluid is a liquid.

9. The method of claim 6 wherein part (d) is performed while fluid is pumped between casing and tubing.

10. The method of claim 6 wherein part (d) comprises breaching a tubing-conveyed container holding a quantity of activator.

11. An apparatus for fracturing with resin-coated proppant a subsurface formation adjacent to a cased well containing tubing comprising:

(a) a tubing-conveyed container holding a quantity of resin activator and situated in a wellbore adjacent to perforations in casing lining the wellbore;

(b) a surface-controlled breaching device coupled to said container;

(c) a surface pump having an outlet positioned to pump fluid under pressure between casing and tubing; and (d) a surface pressure monitor positioned to measure pressure in the casing-tubing annulus.

12. The apparatus of claim 11 further comprising a gamma-ray monitor positioned in the tubing at a predetermined vertical spacing from the perforations.

13. The apparatus of claim 11 wherein the tubing extends no deeper than the tubing-conveyed container.

14. The apparatus of claim 11 wherein the tubing extends deeper than the tubing-conveyed container.

15. The apparatus of claim 11 wherein the breaching device comprises a surface pump coupled to breach a plug using hydraulic pressure in the tubing.

16. The apparatus of claim 11 wherein the container comprises a segment of tubing.

17. A method of fracturing a subsurface formation adjacent to a cased well containing tubing comprising:

(a) pumping a mixture containing fluid and non-activated resin-coated proppant downhole between casing and tubing, thereby causing the mixture to pass under pressure through perforations in the casing;

(b) monitoring the pressure in the well;

(c) while pumping the mixture, causing radioactivated tracer to enter the formation with the mixture;

(d) measuring the level of radioactivity at a predetermined vertical distance from the casing perforations;

(e) ceasing the pumping of proppant at the earlier of (i) when the pressure exceeds a first predetermined level, and (ii) when the measured level of radioactivity exceeds a second predetermined level; and (f) after pumping of the proppant is substantially complete, causing an activator fluid to pass from the tubing through perforations in the casing.

18. The method of claim 17 wherein the tracer material is pumped through the tubing and thereafter the activator fluid is pumped through the tubing.

19. The method of claim 17 wherein part (f) is performed while fluid is pumped between casing and tubing.

20. The method of claim 17 wherein the activator fluid is pumped at a surface injection pressure at least as great as the monitored surface injection annulus pressure.

21. The method of claim 17 further comprising, after part (f), pumping fluid down the tubing and up the annulus between the casing and the tubing.

22. The method of claim 17 wherein part (f) comprises breaching a tubing-conveyed container holding a quantity of activator.

23. A method of fracturing a subsurface formation adjacent to a cased well containing tubing comprising:

(a) pumping a mixture containing fluid and non-activated resin-coated proppant downhole between casing and tubing, thereby causing the mixture to pass under pressure through perforations in the casing; and (b) after pumping of the proppant is substantially complete, causing an activator fluid tagged with a radioactive tracer to pass from the tubing through perforations in the casing.

24. The method of claim 23 wherein part (b) is performed while fluid is pumped between casing and tubing.

25. The method of claim 23 further comprising, during part (a), monitoring the pressure in the well and ceasing the pumping of proppant when the pressure exceeds a predetermined level.

26. The method of claim 25 wherein the activator fluid is pumped at a surface injection pressure at least as great as the monitored surface injection annulus pressure.

27. The method of claim 23 further comprising measuring the level of radioactivity at a predetermined vertical distance from the casing perforations.

28. The method of claim 23 wherein part (b) comprises breaching a tubing-conveyed container holding a quantity of activator.

29. The method of claim 23 further comprising, after part (b), pumping fluid down the tubing and up the annulus between the casing and the tubing.

* * * * *